United States Patent [19]

Blum et al.

[11] 4,278,433

[45] Jul. 14, 1981

[54] RESIST PRINTING PROCESS

[75] Inventors: Adolf Blum; Siegmar Lukas; Hermann Schwab, all of Ludwigshafen; Rolf Strobel, Niederkirchen, all of Fed. Rep. of Germany

[73] Assignee: BASF Aktiengesellschaft, Ludwigshafen, Fed. Rep. of Germany

[21] Appl. No.: 141,404

[22] Filed: Apr. 18, 1980

[30] Foreign Application Priority Data

Apr. 25, 1979 [DE] Fed. Rep. of Germany ..... 2916673

[51] Int. Cl.[3] ..... D06P 5/12

[52] U.S. Cl. ..... 8/449; 8/549; 8/591; 8/608; 8/918

[58] Field of Search ..... 8/449, 549, 918, 591

[56] References Cited

U.S. PATENT DOCUMENTS

| | | | |
|---|---|---|---|
| 2,895,785 | 7/1959 | Alsberg et al. | 8/449 |
| 3,125,403 | 3/1964 | Senger | 8/449 |
| 3,700,402 | 10/1972 | Noda et al. | 8/449 |

FOREIGN PATENT DOCUMENTS 2326522 12/1974 Fed. Rep. of Germany .

OTHER PUBLICATIONS

Chemical Abstracts, 71, 125912w, 1969.
Chemical Abstracts, 82, 87587m, 1975.

*Primary Examiner*—A. Lionel Clingman
*Attorney, Agent, or Firm*—Oblon, Fisher, Spivak, McClelland & Maier

[57] ABSTRACT

A process for the production of resist prints under reactive dyes on textile materials which consist of cellulose fibers or a blend of cellulose fibers with other fibers, using reaction products of bisulfite adducts of aldehydes of 2 to 6 carbon atoms, or of ketones, with ammonia, primary amines or secondary amines in the molar ratio of from 3:1 to 1:1 as resists. Preferably, reaction products of a bisulfite adduct of acetaldehyde and ammonia in the molar ratio of from 3:1 to 1:1 are employed as resists. Because of the high stability of the resist print pastes, high color yields of the resist dye and satisfactory, reproducible resist effects of the ground dye are achieved.

9 Claims, No Drawings

RESIST PRINTING PROCESS

German Published Application DAS No. 2,326,522 discloses a process for producing resist effects with reactive dyes under reactive dyes on sheet-like textile materials consisting of natural or regenerated cellulose fibers. In this known process, the following are applied to the textile material: sulfites, thiosulfates or thioureas as resists, alkalis as fixatives, a category of reactive dyes which react with the resist and in which the reactive group is the β-sulfatoethylsulfone or β-sulfatoethylsulfonamide group, and another category of reactive dyes which on fixing do not react with the resist. The resist is applied to the textile material by preprinting or overprinting. The dyes are fixed by steaming or by treatment with hot air.

If printing is carried out with resist print pastes which contain reactive dyes, for example of the monochlorotriazine type, as well as the additives required for direct printing, such as alkali, thickeners, oxidizing agents, urea and the resist, it is found that the stability of such pastes is very limited and depends on the particular monochlorotriazine dye. This is also true of other types of reactive dye. This is also true of other types of reactive dye. Consequently, a decrease in the depth of color with storage time of the resist print pastes is found, ie. the depth of color of the resist effects is insufficiently reproducible. A further disadvantage of the process carried out with sulfites is that the ground dyeings or ground prints in the no-resist areas can become paler or lighter with increasing size of the batch, the effect depending on the type of steamer used. An explanation of this phenomenon is that on steaming the resist prints sulfur dioxide passes into the steam chamber, accumulates there and acts on the resistable ground dye in the no-resist areas.

German Published Application DAS No. 1,619,606 discloses a resist printing process in which the resist agent used is an alkali metal hydroxymethanesulfonate or a substance which forms such a compound under the conditions of use. However, it has been found that alkali metal hydroxymethanesulfonates frequently cannot react sufficiently rapidly with the reactive dyes containing β-sulfatoethylsulfone or sulfatoethylsulfonamide groups. A satisfactory resist effect is only achievable if the resist reacts very rapidly with the dyes. Only a very short period is available for this reaction, namely from the time at which the resist encounters the ground dye on the printing machine or padder to when the drying process is carried out. This is because, on drying, partial fixing of the ground dye may occur even in the resist areas, especially if drying temperatures of 130° C. or above are used, as is nowadays quite common.

The alkali metal hydroxymethanesulfonates have the further disadvantage—unless they are in the form of adducts—that the resist effects show insufficient depth of color and/or color yields. This may be attributable to a reaction between the hydroxyl group of the alkali metal hydroxymethanesulfonate and the reactive dyes used for the resist print pastes.

The above disadvantages of the resist processes of German Published Applications DAS No. 2,326,522 and DAS No. 1,619,606 have had the effect that the resist printing process with reactive dyes under reactive dyes, which is of great interest, has only been used sporadically and has not hitherto found any wide application in textile printing.

It is an object of the present invention to provide a resist for resist printing processes which permits the preparation of more stable resist print pastes, and gives high color yields of the resist dyes and satisfactory resist effects of the ground dyes, ie. which allows the resist printing process to be carried out reliably and reproducibly.

We have found that this object is achieved, according to the invention, by using reaction products of bisulfite adducts of aldehydes of 2 to 6 carbon atoms, or of ketones, with ammonia or primary or secondary amines, in the molar ratio of from 3:1 to 1:1, as resists in processes for the production of resist prints under reactive dyes on textile materials which consist of cellulose fibers or of blends of cellulose fibers with other fibers.

Bisulfite adducts of aldehydes of 2 to 6 carbon atoms are known. For example, they are prepared by reacting the aldehydes with sodium bisulfite or potassium bisulfite in aqueous solution. The molar ratio of ketone group or aldehyde group to bisulfite is 1:1. Examples of suitable aldehydes are acetaldehyde, propionaldehyde, n-butyraldehyde, isobutyraldehyde, glyoxal, glutarodialdehyde, methoxyacetaldehyde, n-valeraldehyde and isovaleraldehyde. Of the ketones, acetone, hydroxyacetone, methyl ethyl ketone and cyclohexanone are particularly suitable.

The resist agents are obtained by reacting the bisulfite adducts with ammonia or primary or secondary amines in the molar ratio of from 3:1 to 1:1. Compounds of this type are known. Particularly suitable primary and secondary amines are methylamine, dimethylamine, isopropylamine, N- and isobutylamine, ethylenediamine, hexamethylenediamine and diethylenetriamine. Acetaldehyde is a suitable aldehyde for use in the bisulfite adduct. Sodium and potassium 1,1′,1″-nitrilotriethanesulfonate are particularly important resists. Particularly stable resist print pastes are obtained when using the potassium salt. Of course, mixtures of the resists in question may also be used.

Suitable reactive dyes are those which contain a β-sulfatoethylsulfone, β-sulfatoethylsulfonamide or vinyl sulfone group. Reactive dyes which do not react with the resists used according to the invention, ie. which do not give resist effects, may, for example, contain the following reactive groups: monochlorotriazine, dichlorotriazine, dichloropyrimidine, trichloropyrimidine, dichloropyridazine and chloroaminotriazine. The two different categories of reactive dyes, of which only one reacts with the resist, may be selected, for example, from the Color Index. Suitable products of this type are commercially available.

Resist prints may be produced by various processes. For example, it is possible first to apply, to a textile fabric, a pattern of a resist print paste which contains the resist and a reactive dye which does not react with the resist. After an intermediate drying, if appropriate, the printed material is then treated overlappingly, or over its entire surface, with a print paste which in addition to conventional print paste constituents contains a reactive dye which reacts with the resist. This last print paste serves to dye the ground of the material. The print paste may thus be applied either by means of a patterned roller or with a 1,000-dot roller, according to which embodiment is used. The ground can also be dyed by padding.

An alternative procedure is first to pad a cotton fabric with a liquor which in addition to conventional constituents, such as an oxidizing agent, a thickener and water, but no alkali, contains a reactive dye which reacts with the resist. The padded fabric is then dried and pattern-printed by means of a printing roller, or by spray-printing, with a print paste which in addition to conventional constituents contains a resist to be used according to the present invention, and a reactive dye which is stable to the resist. The print paste which has been applied in a pattern may contain the alkali required for fixing the reactive dyes. However, it is also possible to apply an alkalifree print paste but in this case alkali must subsequently be applied to the goods in order to fix the ground dyes.

A resist effect (resist white) is obtained if a fabric is printed over its entire surface, using a rotary screen, with a print paste which in addition to conventional constituents contains a reactive dye which reacts with the resist. Before or after this, a pattern is printed on the fabric by means of a print paste which contains the resist as an essential constituent. After fixing the dyes, a clear white hue is obtained on a colored ground. Further possible variations may be achieved by additional use of other dyes, for example developed dyes, which are produced on the fibers by coupling diazotized compounds with naphthol derivatives (giving naphthol dyes).

The preferred process is that in which the resist is applied together with the reactive dye which is stable to the resist. In a further possible process for the production of resist prints, a pattern of the resist is first applied to the textile material and two or more different print pastes are then printed on the material in a conventional manner.

Resist prints are preferably produced with reactive dyes under reactive dyes on sheet-like textile materials which consist of cellulose fibers or of blends of these with other fibers. Suitable textile materials are, in particular, woven fabrics, knitted fabrics and nonwovens. These materials preferably consist either of cotton or of regenerated cellulose or of blends of these two types of fibers. However, blends of cellulose fibers and synthetic fibers, eg. polyester or nylon, may also be used.

Particularly stable resist print pastes are obtained if potassium 1,1′,1″-nitrilotriethanesulfonate is used as the resist. Both sodium 1,1′,1″-nitrilotriethanesulfonate and the corresponding potassium compound give substantially better results, compared to conventional resists, in respect of the fixing of the dyes for the colored effects, so that greater depths of color and better reproducibility of the colored resists are obtained. In this context, the greater stability of the novel resist print pastes, compared to conventional pastes, is to be noted. Whilst, for example, conventional resist print pastes containing sodium sulfite as the resist give only a 50% color yield if a yellow reactive dye is used and the paste is stored for two days, the novel resist print pastes, which differ from the conventional pastes in respect of the resist used, give a color yield of almost 100% even after eight days' storage. This substantial improvement in stability shown by the novel resist print pastes was not foreseeable.

The reactive dyes are fixed in a conventional manner in the presence of an alkali at an elevated temperature, for example at from 100° to 160° C. They may also be fixed in a hot liquor which contains sodium hydroxide, sodium carbonate, potassium carbonate or mixtures of these.

The novel resists are not merely useful—as described above—for use, together with suitable reactive dyes, in the production of resist prints with reactive dyes under reactive dyes. They may, in addition, be used for processes in which colored resist prints are produced, under reactive dyes, by means of other categories of colorants.

For example, the novel resists can be added to the print pastes conventionally used in pigment printing, and resist effects under reactive dyes can thus be produced. In this case, the pigment resist pastes are printed first and the ground color is overprinted with the reactive dyes mentioned, with or without an intermediate drying stage. The dried pigment resist prints can also be overpadded with a liquor containing the ground dye, after which the print is dried, fixed with steam or with hot air and finished by the conventional methods for reactive prints.

In the conventional industrial processes for the production of resist prints using pigment dyes under reactive dyes, non-volatile acids, eg. tartaric acid, are used as resists for the reactive dyes. However, this conventional process has various disadvantages. With a view to the stability of the print pastes, the acid is not added directly to the pigment print paste but must be added thereto as a mixture with an acid-resistant natural thickener, for example based on hydroxyethylcellulose. The synthetic thickeners extensively used in pigment printing at the present time can, on the other hand, not be employed together with the large amounts of acid required in resist printing with pigment dyes, since they no longer act as thickeners under these conditions.

The use of the novel resists in resist printing with pigment dyes therefore has the following advantages over the conventional process:

The natural thickeners are not required and therefore a softer hand is achieved, The use of synthetic thickeners for the first time makes it possible to use the gasoline-free pigment printing in resist printing and The resist is added directly to the print paste, thereby simplifying the process.

The novel resists can also be added to vat print pastes which are used in direct printing and which contain sodium hydroxymethanesulfinate as the reducing agent for the vat dyes. In this way, print pastes for resist printing with vat dyes under reactive dyes are obtained. The resist print pastes are printed first; in the same pass, the ground color is overprinted with the above reactive dyes. It is, however, also possible first to pad the fabric with the reactive ground color, in which case the padding liquor must, in order to avoid premature fixing of the reactive dye, not contain any alkali. After padding and drying, the resist print pastes are printed onto the fabric and dried. Thereafter the alkali required for fixing the reactive dyes is applied on a padder, using the two-phase process—and the ground dyeing and vat print are fixed simultaneously by steaming.

Resist printing with vat dyes under reactive dyes is substantially simpler and more reliable than the vat discharge printing process which is extensively used at the present time and which starts from a finished reactive dyeing. A number of important reactive dyes are difficult to discharge. In order to achieve a satisfactory discharge effect with these dyes, sodium hydroxide solution is added to the print pastes. This can lead to insufficient stability of the discharge print pastes. Such difficulties do not arise with the novel resist printing process employing vat dyes.

The resists to be employed according to the invention are used in the conventional amounts, ie. 1,000 parts by weight of the print paste contain from 5 to 100, preferably from 10 to 50, parts by weight of the resist, though when coupling dyes are employed it is preferred to use from 50 to 90 parts by weight of the resist. The dyes are also employed in the conventional amounts. Except for producing the resist white, 1,000 parts by weight of the resist print paste contain from 1 to 100 parts by weight of a reactive dye. The other types of colorants which may be employed are also used in conventional amounts.

The Examples which follow illustrate the invention. Parts are by weight. The colorants were employed in the form of their commercial formulations.

EXAMPLE 1

A print paste consisting of

| | |
|---|---|
| 40 parts of | the yellow reactive dye, Color Index No. 13,245, in the form of a commercial formulation, |
| 500 parts of | 10% strength aqueous alginate thickener |
| 100 parts of | urea |
| 10 parts of | sodium m-nitrobenzenesulfonate |
| 20 parts of | sodium carbonate |
| 40 parts of | potassium 1,1',1''-nitrilotriethanesulfonate |
| 290 parts of | water |
| 1,000 parts | |

are applied, by means of a patterned screen, to a mercerized cotton fabric. In the same pass, without intermediate drying, the fabric is printed overlappingly, using a patterned screen, with a print paste consisting of:

| | |
|---|---|
| 60 parts of | the black reactive dye, Color Index No. 20,505 |
| 500 parts of | 10% strength aqueous alginate thickener |
| 100 parts of | urea |
| 10 parts of | sodium m-nitrobenzenesulfonate |
| 25 parts of | sodium bicarbonate |
| 305 parts of | water |
| 1,000 parts | |

After drying, the fabric is steamed for 5 minutes with saturated steam and is finished in a conventional manner for reactive prints. A clear yellow colored effect on a black ground is obtained.

EXAMPLE 2

A print paste consisting of

| | |
|---|---|
| 40 parts of | the blue reactive dye, Color Index No. 61,210 |
| 500 parts of | 6% strength aqueous alginate thickener |
| 100 parts of | urea |
| 10 parts of | sodium m-nitrobenzenesulfonate |
| 20 parts of | sodium carbonate |
| 40 parts of | potassium 1,1',1''-nitrilotriethane-sulfonate |
| 290 parts of | water |
| 1,000 parts | |

is printed onto a viscose fabric by means of a patterned printing roller. After the fabric has been dried, it is printed overlappingly, using a patterned roller, with a print paste consisting of:

| | |
|---|---|
| 40 parts of | the yellow reactive dye, Color Index No. 18,852 |
| 500 parts of | 6% strength aqueous alginate thickener |
| 100 parts of | urea |
| 10 parts of | sodium m-nitrobenzenesulfonate |
| 25 parts of | sodium bicarbonate |
| 325 parts of | water |
| 1,000 parts | |

After the fabric has been dried, it is steamed for 5 minutes with saturated steam, washed and soaped in a conventional manner. A blue colored effect on a yellow ground is achieved.

The same effect is obtained if after printing the fabric with the resist print paste and drying it, a ground color of the following composition

| | |
|---|---|
| 40 parts of | the yellow reactive dye, Color Index No. 18,852 |
| 50 parts of | 10% strength aqueous alginate thickener |
| 10 parts of | sodium m-nitrobenzenesulfonate |
| 20 parts of | sodium bicarbonate |
| 880 parts of | water |
| 1,000 parts | |

is padded onto the viscose fabric, and dried. The fabric is then steamed and finished as above.

EXAMPLE 3

A dye liquor of the following composition is padded onto a cotton fabric:

| | |
|---|---|
| 50 parts of | the violet reactive dye, Color Index No. 18,097 |
| 100 parts of | 10% strength aqueous alginate thickener |
| 10 parts of | sodium m-nitrobenzenesulfonate |
| 840 parts of | water |
| 1,000 parts | |

The dried fabric is printed, using a patterned roller, with a print paste consisting of

| | |
|---|---|
| 40 parts of | the greenish blue reactive dye, Color Index No. 74,459, |
| 500 parts of | 10% strength aqueous alginate thickener |
| 100 parts of | urea |
| 10 parts of | sodium m-nitrobenzenesulfonate |
| 20 parts of | sodium carbonate |
| 40 parts of | potassium 1,1',1''-nitrilotriethane sulfonate |
| 290 parts of | water |
| 1,000 parts | |

After the fabric has been dried, it is padded with a fixing solution consisting of

| | |
|---|---|
| 150 parts of | sodium carbonate |
| 50 parts of | potassium carbonate |
| 150 parts of | sodium chloride |
| 50 parts of | sodium hydroxide solution, 38° Be strength |
| 600 parts of | water |
| 1,000 parts | |

The fabric is then steamed in a two-phase steamer for 30 seconds at 110° C. and is finished in a conventional manner. A greenish blue colored effect on a violet ground is obtained.

EXAMPLE 4

A cotton fabric is printed, by means of a rotary screen, with a print paste consisting of:

| | |
|---|---|
| 40 parts of | the yellowish red reactive dye, Color Index No. 17,757 |
| 500 parts of | 10% strength aqueous alginate thickener |
| 100 parts of | urea |
| 10 parts of | sodium m-nitrobenzenesulfonate |
| 25 parts of | sodium bicarbonate |
| 325 parts of | water |
| 1,000 | |

The fabric is printed in the same pass, by means of a second rotary screen, with a paste which contains the following constituents:

| | |
|---|---|
| 40 parts of | sodium 1,1',1''-nitrilotriethanesulfonate |
| 500 parts of | 10% strength aqueous alginate thickener |
| 100 parts of | urea |
| 10 parts of | sodium m-nitrobenzenesulfonate |
| 20 parts of | sodium carbonate |
| 330 parts of | water |
| 1,000 parts | |

After drying, the print is fixed with hot air for 4 minutes at 150° C. and finished in a conventional manner. A clear white hue on a red ground is obtained.

EXAMPLE 5

A cotton fabric is padded with a liquor of the following composition:

A mixture of

| |
|---|
| 12 parts of the naphthol dye, Color Index No. 37,505 |
| 10 parts of a sulfate of a polyricinoleic acid soap |
| 15 parts of sodium hydroxide solution of 38° Bé strength |

is stirred into 300 parts of water at 90° C. This solution is made up to 1,000 parts with water.

A dye paste consisting of

| | |
|---|---|
| 40 parts of | the yellow reactive dye, Color Index No. 18,972 |
| 500 parts of | 10% strength aqueous alginate thickener |
| 100 parts of | urea |
| 10 parts of | sodium m-nitrobenzenesulfonate |
| 20 parts of | sodium carbonate |
| 40 parts of | potassium 1,1',1''-nitrilotriethanesulfonate |
| 290 parts of | water |
| 1,000 parts | |

is printed by means of a patterned screen onto the padded and dried fabric.

In the same pass, a print paste consisting of

| | |
|---|---|
| 40 parts of | the blue reactive dye, Color Index No. 61,200 |
| 500 parts of | 10% strength aqueous alginate thickener |
| 30 parts of | urea |
| 10 parts of | sodium m-nitrobenzenesulfonate |
| 420 parts of | water |
| 1,000 parts | |

is applied overlappingly by means of a patterned screen.

In addition to this, the fabric is printed, by means of another patterned screen, with a print paste consisting of:

| | |
|---|---|
| 50 parts of | the diazo compound, Color Index No. 37,085 |
| 1 parts of | the sodium salt of a condensate of naphthalenesulfonic acid and formaldehyde |
| 300 parts of | water |
| 10 parts of | 50% strength $CH_3 . COOH$ |
| 639 parts of | 6% strength aqueous tragacanth thickener |
| 1,000 parts | |

After drying, development is carried out by the alkali shock process, in which the printed textile fabric shock process, in which the printed textile fabric is left for 15 seconds in a developing liquor at 98° C. The developing liquor consists of:

| | |
|---|---|
| 150 parts of | sodium chloride |
| 150 parts of | sodium carbonate |
| 50 parts of | potassium carbonate |
| 70 parts of | sodium hydroxide solution of 38° Be strength |
| 580 parts of | water |
| 1,000 parts | |

A yellow pattern is a blue field on a red ground is obtained.

The dyes can also be fixed by the two-phase steaming process described in Example 3.

EXAMPLE 6

A print paste consisting of:

| | |
|---|---|
| 40 parts of | the yellow pigment dye, Color Index No. 21,108 |
| 40 parts of | a 1:1 by weight mixture of a copolymer of maleic anhydride and vinyl isobutyl ether, crosslinked with hexamethylenediamine, and a 50% strength solution, in gasoline, of a high molecular weight polyacrylic acid neutralized with ammonia |
| 10 parts of | an adduct of p-benzyl-o-phenylphenol with from 12 to 16 moles of ethylene oxide |
| 7 parts of | polydimethylsiloxane |
| 5 parts of | hexamethylolmelamine hexamethyl ether |
| 5 parts of | a reaction product of an adduct of a $C_{16}$-alcohol with 80 moles of ethylene oxide and hexamethylene diisocyanate |
| 150 parts of | a binder consisting of a 40% strength aqueous dispersion of a copolymer of 60% of butyl acrylate, 35% of styrene and 5% of N-methylolmethacrylamide |
| 40 parts of | sodium 1,1',1''-nitrilotriethanesulfonate |
| 703 parts of | water |
| 1,000 parts | |

is applied, by means of a patterned screen, to a mercerized cotton fabric.

In the same pass, the fabric, without intermediate drying, is printed overlappingly, by means of a patterned screen, with a print paste consisting of:

| | |
|---|---|
| 60 parts of | the black reactive dye, Color Index No. 20,505 |
| 500 parts of | 10% strength aqueous alginate thickener |
| 100 parts of | urea |
| 10 parts of | sodium m-nitrobenzenesulfonate |
| 25 parts of | sodium bicarbonate |
| 305 parts of | water |

-continued

| | |
|---|---|
| 1,000 parts | |

After drying, the fabric is steamed for 6 minutes at 170° C. and is finished in a conventional manner for reactive prints.

A yellow colored effect on a black ground is obtained.

The same effect is obtained if after printing with the resist paste, the fabric is subjected to an intermediate drying and is then padded with a dye liquor of the following composition:

| | |
|---|---|
| 60 parts of | the black reactive dye, Color Index No. 20,505 |
| 50 parts of | 10% strength aqueous alginate thickener |
| 10 parts of | sodium m-nitrobenzenesulfonate |
| 20 parts of | sodium bicarbonate |
| 860 parts of | water |
| 1,000 parts | |

After drying the fabric is fixed and finished as described above.

EXAMPLE 7

A print paste of the following composition is applied to a cotton fabric by means of a patterned screen:

| | |
|---|---|
| 40 parts of | the yellow vat dye, Color Index No. 68,420 |
| 650 parts of | 10% strength aqueous starch-ether thickener |
| 100 parts of | potassium carbonate |
| 120 parts of | sodium hydroxymethanesulfonate |
| 20 parts of | thiodiethylene glycol |
| 40 parts of | potassium 1,1',1''-nitrilotriethanesulfonate |
| 30 parts of | water |
| 1,000 parts | |

In the same pass, the fabric is printed overlappingly by means of a patterned screen with a print paste consisting of

| | |
|---|---|
| 40 parts of | the blue reactive dye, Color Index No. 61,200 |
| 500 parts of | 10% strength aqueous alginate thickener |
| 100 parts of | urea |
| 10 parts of | sodium m-nitrobenzenesulfonate |
| 25 parts of | sodium bicarbonate |
| 325 parts of | water |
| 1,000 parts | |

After drying, the fabric is steamed for 7 minutes at 102° C. and is finished in a conventional manner for vat dyes.

A pure yellow colored effect on a brilliant blue ground is obtained.

We claim:

1. In an improved process for the production of resist prints under reactive dyes on textile materials which consist of cellulose fibers or of blends of these with other fibers, by padding, pre-printing or overprinting the textile material with a padding liquor or print paste which contains a resist, the improvement which comprises said resist being the reaction product of a bisulfite adduct of an aldehyde of 2 to 6 carbon atoms, or of a ketone, with ammonia or a primary or secondary amine, in the molar ratio of from 3:1 to 1:1.

2. The process as claimed in claim 1, wherein said resist is the reaction product of a bisulfite adduct of acetaldehyde and ammonia in a molar ratio of from 3:1 to 1:1.

3. The process as claimed in claim 1, wherein said resist is sodium or potassium 1,1',1''-nitrilotriethanesulfonate.

4. The process as claimed in claim 1, wherein resist prints are produced with reactive dyes under reactive dyes with potassium 1,1',1''-nitrilotriethanesulfonate as the resist.

5. The process as claimed in claim 1, wherein said primary or secondary amine is selected from the group consisting of methylamine, dimethylamine, isopropylamine, isobutylamine, ethylenediamine, hexamethylenediamine and diethylenetriamine.

6. The process as claimed in claim 1, wherein said ketone is acetone, hydroxyacetone, methylethylketone or cyclohexanone.

7. The process as claimed in claim 1, wherein said aldehyde is acetaldehyde, propionaldehyde, n-butyraldehyde, isobutyraldehyde, glyoxal, glutarodialdehyde, methoxyacetaldehyde, n-valeraldehyde or isovaleraldehyde.

8. The process as claimed in claim 1, wherein said resist component comprises from 5 to 100 parts by weight per 1000 parts by weight of said print paste.

9. The process as claimed in claim 1, wherein said reactive dye contains a reactive group selected from the group consisting of monochlorotriazine, dichlorotriazine, dichloropyrimidine, trichloropyrimidine, dichloropyridazine and chloroaminotriazine.

* * * * *